US009230768B2

(12) United States Patent
Thomas et al.

(10) Patent No.: US 9,230,768 B2
(45) Date of Patent: Jan. 5, 2016

(54) CIRCUIT BREAKER THERMAL-MAGNETIC TRIP UNITS AND METHODS

(75) Inventors: Stephen Scott Thomas, Atlanta, GA (US); Esteban Sandoval Camacho, Monterrey (MX)

(73) Assignee: Siemens Aktiengesellschaft, München (DE)

( * ) Notice: Subject to any disclaimer, the term of this patent is extended or adjusted under 35 U.S.C. 154(b) by 0 days.

(21) Appl. No.: 14/368,390

(22) PCT Filed: Feb. 28, 2012

(86) PCT No.: PCT/US2012/026912

§ 371 (c)(1), (2), (4) Date: Sep. 19, 2014

(87) PCT Pub. No.: WO2013/130044

PCT Pub. Date: Sep. 6, 2013

(65) Prior Publication Data

US 2015/0022290 A1 Jan. 22, 2015

(51) Int. Cl.

| | |
|---|---|
| ***H01H 75/00*** | (2006.01) |
| ***H01H 71/12*** | (2006.01) |
| ***H01H 71/40*** | (2006.01) |
| *H01H 71/10* | (2006.01) |
| *H01H 71/16* | (2006.01) |
| *H01H 71/04* | (2006.01) |

(52) U.S. Cl.

CPC ..... *H01H 71/123* (2013.01); *H01H 71/40* (2013.01); *H01H 71/1009* (2013.01); *H01H 71/16* (2013.01); *H01H 2071/046* (2013.01); *H01H 2071/124* (2013.01)

(58) Field of Classification Search

CPC ..... H01H 71/10; H01H 2071/1036

USPC ..... 335/7

See application file for complete search history.

(56) References Cited

U.S. PATENT DOCUMENTS 2,190,517 A * 2/1940 Jennings ..... H01H 71/527 337/112

2,195,016 A * 3/1940 Swingle ..... H01H 73/24 337/46

(Continued)

FOREIGN PATENT DOCUMENTS

DE 102006005697 A1 8/2007

WO 0116974 A1 3/2001

OTHER PUBLICATIONS

PCT International Search Report mailed Nov. 26, 2012 corresponding to PCT International Application No. PCT/US2012/026912 filed Feb. 28, 2012 (11 pages).

*Primary Examiner* — Shawki S Ismail

*Assistant Examiner* — Lisa Homza

(57) ABSTRACT

A trip unit is provided for a circuit breaker that includes electrical contacts, a trip mechanism, a bimetallic strip, and an armature. The trip unit includes a first trip bar coupled to the trip mechanism and disposed about a pivot point, and a second trip bar coupled to the first trip bar and disposed about the pivot point. In a first operating condition, the first trip bar rotates about the pivot point substantially independently of the second trip bar, and activates the trip mechanism to open the electrical contacts. In a second operating condition, the second trip bar rotates about the pivot point, causing the first trip bar to rotate about the pivot point and activate the trip mechanism to open the electrical contacts. Numerous other aspects are provided.

30 Claims, 4 Drawing Sheets

(56) References Cited

U.S. PATENT DOCUMENTS 2,325,717 A * 8/1943 Swingle ..... H01H 71/40 335/36
2,360,684 A * 10/1944 Jennings ..... H01H 71/40 200/302.3
2,502,537 A * 4/1950 Speck ..... H01H 73/24 335/23
2,677,026 A * 4/1954 Bingenheimer ..... H01H 71/405 335/143
2,701,284 A * 2/1955 Edmunds ..... H01H 71/505 335/167
2,996,589 A * 8/1961 Myers ..... H01H 71/1027 335/11
3,018,351 A * 1/1962 Middendorf ..... H01H 3/001 335/43
3,061,697 A * 10/1962 Kralik ..... H01H 71/162 335/145
3,075,058 A * 1/1963 Platz ..... H01H 73/56 335/145
3,178,535 A * 4/1965 Dyer ..... H01H 71/40 335/188
3,525,959 A * 8/1970 Ellsworth ..... H01H 71/501 200/DIG. 42
3,758,887 A * 9/1973 Ellsworth ..... H01H 71/7463 335/176
3,786,380 A * 1/1974 Harper ..... H01H 71/1027 335/10
3,855,502 A * 12/1974 Pardue ..... H01H 83/04 335/18
4,346,356 A * 8/1982 Fujiwara ..... H01H 71/503 335/14
4,516,098 A * 5/1985 Krasser ..... H01H 71/1027 335/191
4,628,288 A * 12/1986 Fujihisa ..... H01H 71/526 200/401
4,827,231 A 5/1989 Maier
4,983,939 A * 1/1991 Shea ..... H01H 71/7463 335/172
5,214,402 A 5/1993 Lucas
5,258,729 A * 11/1993 Link ..... H01H 71/0228 335/132
5,266,760 A * 11/1993 Link ..... H01H 71/0257 200/244
6,100,777 A * 8/2000 Mueller ..... H01H 71/002 335/172
6,137,386 A 10/2000 Mueller
6,218,920 B1 * 4/2001 Reichard ..... H01H 71/7463 335/172
6,222,433 B1 * 4/2001 Ramakrishnan ..... H01H 1/2058 200/308
6,225,882 B1 * 5/2001 Hood ..... H01H 71/0214 335/172
6,252,480 B1 * 6/2001 Kramer ..... H01H 77/102 335/16
6,259,341 B1 * 7/2001 Juds ..... H01H 71/405 335/172
6,259,342 B1 * 7/2001 Malingowski ..... H01H 71/501 335/172
6,480,079 B1 * 11/2002 Bentley ..... H01H 71/58 200/401
6,747,534 B1 * 6/2004 Mueller ..... H01H 21/50 335/172
6,750,743 B1 * 6/2004 Subramanian ..... H01H 1/2058 200/306
2009/0224861 A1 9/2009 Tetik
2010/0073113 A1 * 3/2010 Yang ..... H01H 71/123 335/15

* cited by examiner

CIRCUIT BREAKER THERMAL-MAGNETIC TRIP UNITS AND METHODS

BACKGROUND

This invention relates generally to circuit breakers, and more particularly to circuit breaker thermal magnetic trip units and methods.

Circuit breakers typically include one or more electrical contacts, and provide protection against persistent over-current conditions and short circuit conditions. In many circuit breakers, a thermal-magnetic trip unit includes a thermal trip portion which trips the circuit breaker on persistent over-current conditions, and a magnetic trip portion which trips the circuit breaker on short circuit conditions. Existing thermal-magnetic trip units typically include a single trip bar that releases a trip mechanism to trip the circuit breaker and open the electrical contacts to stop the flow of current in the protected circuit.

However, existing thermal-magnetic trip units typically do not isolate thermal trip events from magnetic trip events.

SUMMARY

In a first aspect, a trip unit is provided for a circuit breaker that includes electrical contacts, a trip mechanism, a bimetallic strip, and an armature. The trip unit includes a first trip bar coupled to the trip mechanism and disposed about a pivot point, and a second trip bar coupled to the first trip bar and disposed about the pivot point. In a first operating condition, the first trip bar rotates about the pivot point substantially independently of the second trip bar, and activates the trip mechanism to open the electrical contacts. In a second operating condition, the second trip bar rotates about the pivot point, causing the first trip bar to rotate about the pivot point and activate the trip mechanism to open the electrical contacts.

In a second aspect, a circuit breaker is provided that includes electrical contacts, a trip mechanism, a bimetallic strip, an armature, and a trip unit. The trip unit includes a first trip bar coupled to the trip mechanism and disposed about a pivot point, and a second trip bar coupled to the first trip bar and disposed about the pivot point. In a first operating condition, the first trip bar rotates about the pivot point substantially independently of the second trip bar, and activates the trip mechanism to open the electrical contacts. In a second operating condition, the second trip bar rotates about the pivot point, causing the first trip bar to rotate about the pivot point and activate the trip mechanism to open the electrical contacts.

In a third aspect, a trip method is provided for use with a circuit breaker that includes electrical contacts, a trip mechanism, a bimetallic strip, and an armature. The trip method includes providing a first trip bar coupled to the trip mechanism and disposed about a pivot point, and providing a second trip bar coupled to the first trip bar and disposed about the pivot point. The trip method further includes in a first operating condition, rotating the first trip bar about the pivot point substantially independently of the second trip bar, and activating the trip mechanism to open the electrical contacts, and in a second operating condition, rotating the second trip bar about the pivot point, causing the first trip bar to rotate about the pivot point and activate the trip mechanism to open the electrical contacts. Numerous other aspects are provided.

BRIEF DESCRIPTION OF THE DRAWINGS

Features of the present invention can be more clearly understood from the following detailed description considered in conjunction with the following drawings, in which the same reference numerals denote the same elements throughout, and in which.

DETAILED DESCRIPTION

The present invention provides thermal-magnetic trip units and methods that include separate thermal and magnetic trip bars that may be used to isolate thermal trip events from magnetic trip events.

Referring to FIGS. 1A-1F, an example thermal-magnetic trip unit in accordance with this invention is described. Thermal-magnetic trip unit 100 includes a first trip bar 110 disposed about a pivot point 112, and a second trip bar 210 also disposed about pivot point 112. As described in more detail below, in a first operating condition (e.g., an over-current or thermal trip condition), first trip bar 110 rotates about pivot point 112, and activates a trip mechanism (not shown) to open electrical contacts (not shown) of a circuit breaker. In this regard, first trip bar 110 is also referred to herein as "thermal trip bar 110."

In addition, as described in more detail below, in a second operating condition (e.g., a short-circuit or magnetic trip condition), second trip bar 210 rotates about pivot point 112, causing first trip bar 110 to rotate about pivot point 112 and activate the trip mechanism to open the electrical contacts of the circuit breaker. In this regard, second trip bar 210 is also referred to herein as "magnetic trip bar 210."

As described in more detail below, in the over-current operating condition, thermal trip bar 110 rotates about pivot point 112 substantially independently of magnetic trip bar 210. In a short circuit condition, in contrast, thermal trip bar 110 and magnetic trip bar 210 both rotate together about pivot point 112. As described in more detail below, the isolation of thermal trip bar 110 and magnetic trip bar 210 may be used to identify a short circuit trip event in a thermal-magnetic circuit breaker.

Figure 1B:
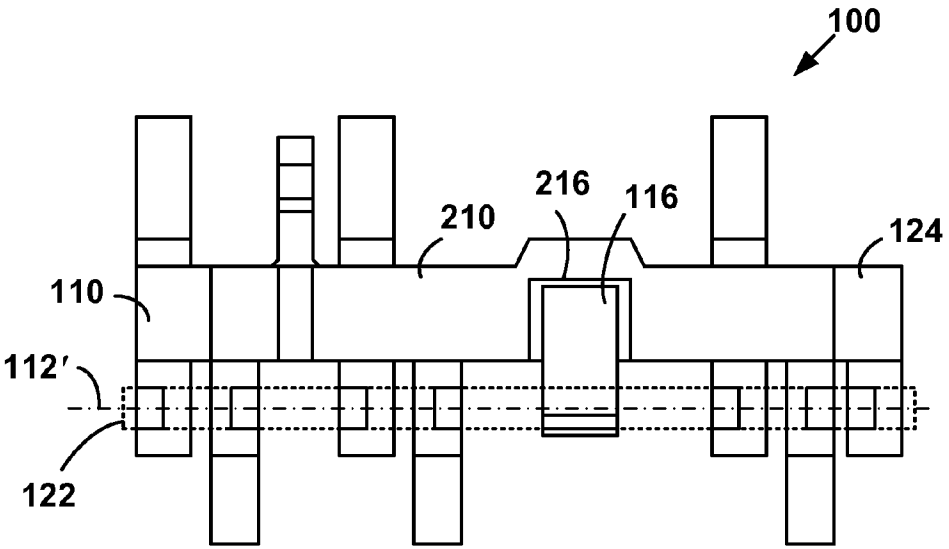
FIG. 1B is a front view of the example thermal-magnetic trip unit of FIG. 1A.
Figure 1A:
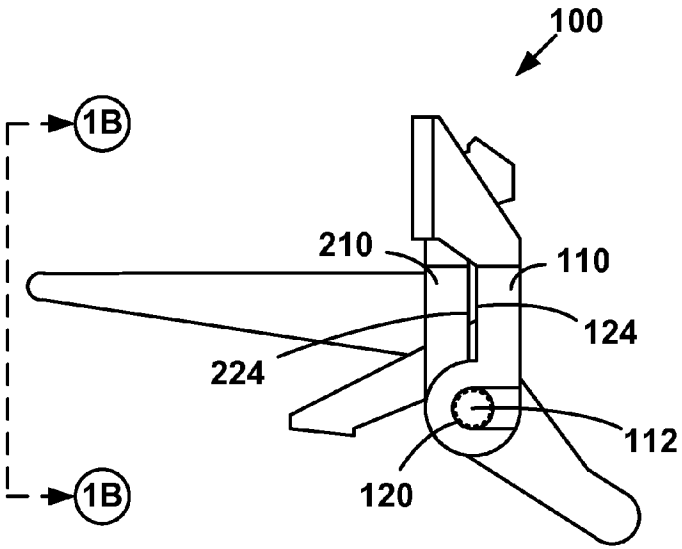
FIG. 1A is a side view of an example thermal-magnetic trip unit in accordance with this invention.
Figure 1C:
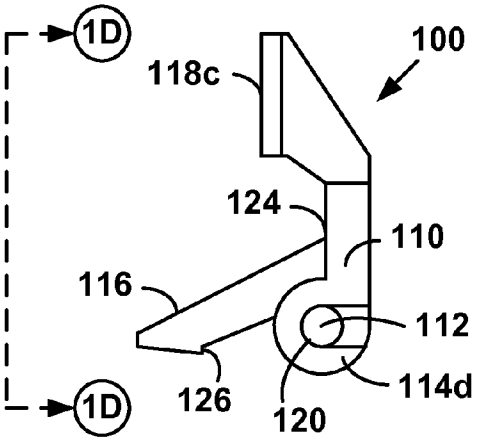
FIG. 1C is a side view of the example thermal trip bar of FIG. 1A.
Figure 1D:
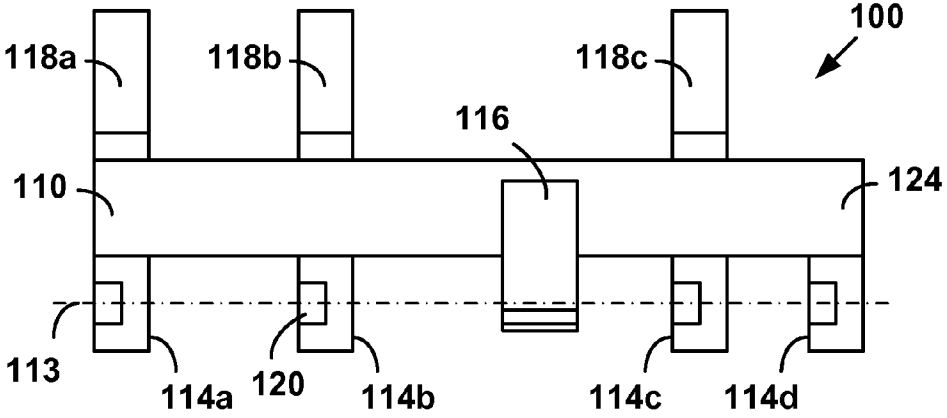
FIG. 1D is a front view of the example thermal trip bar of FIG. 1C.

As shown in FIGS. 1C-1D, thermal trip bar 110 includes cylindrical support members 114*a*-114*d*, latch mechanism 116, and bi-metal interfaces 118*a*-118*c*. Cylindrical support members 114*a*-114*d* support thermal trip bar 110 about pivot point 112. For example, each cylindrical support member 114*a*-114*d* may include a cylindrical bore 120 concentrically aligned along a common axis 113. Although thermal trip bar 110 includes four cylindrical support members 114*a*-114*d*, persons of ordinary skill in the art will understand that thermal trip bars in accordance with this invention may include more than or less than four cylindrical support members 114*a*-114*d*. In addition, persons of ordinary skill in the art will understand that support members 114*a*-114*d* may have shapes other than cylindrical shapes.

Latch mechanism 116 projects from a first surface 124 of thermal trip bar 110, and includes a latch tab 126. In the illustrated example, latch mechanism 116 projects at a downward angle from first surface 124. Persons of ordinary skill in the art will understand that latch mechanism may project at angles other than that illustrated in FIG. 1C. As described in more detail below, latch mechanism 116 is adapted to secure a spring-loaded actuator (not shown in FIGS. 1A-1F) during normal circuit breaker operation, and is adapted to release the spring-loaded actuator to trip the circuit breaker in response to a thermal trip condition or a magnetic trip condition.

In the example illustrated in FIGS. 1C-1D, thermal trip bar 110 includes three bi-metal interfaces 118*a*-118*c*, with one bi-metal interface for each electrical pole of a three-pole circuit breaker. Persons of ordinary skill in the art will understand that thermal trip bars in accordance with this invention may include more than or less than three bi-metal interfaces 118*a*-118*c*, for use with circuit breakers that include more or less than three electrical poles. For example, a single bi-metal interface may be used with a single-pole circuit breaker. Likewise, four bi-metal interfaces may be used with a four-pole circuit breaker.

Figure 1E:
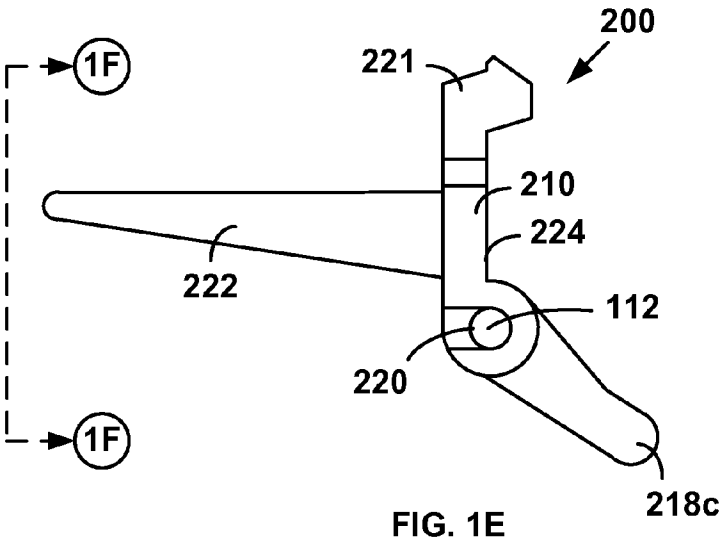
FIG. 1E is a side view of the example magnetic trip bar of FIG. 1A.
Figure 1F:
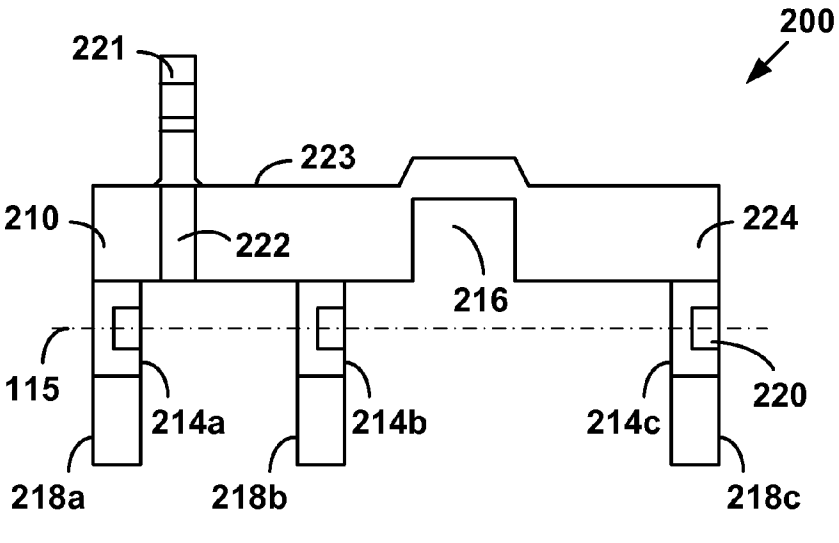
FIG. 1F is a front view of the example magnetic trip bar of FIG. 1E.

Referring now to FIGS. 1E-1F, magnetic trip bar 210 includes cylindrical support members 214*a*-214*c*, opening 216, and armature interfaces 218*a*-218*c*. Cylindrical support members 214*a*-214*c* support magnetic trip bar 210 about pivot point 112. For example, each cylindrical support member 214*a*-214*c* may include a cylindrical bore 220 concentrically aligned along a common axis 115. Although magnetic trip bar 210 includes three cylindrical support members 214*a*-214*c*, persons of ordinary skill in the art will understand that magnetic trip bars in accordance with this invention may include more than or less than three cylindrical support members 214*a*-214*c*. In addition, persons of ordinary skill in the art will understand that support members 214*a*-214*c* may have shapes other than cylindrical shapes.

In the example illustrated in FIGS. 1E-1F, magnetic trip bar 210 includes three armature interfaces 218*a*-218*c*, with one armature interface for each electrical pole of a three-pole circuit breaker. Persons of ordinary skill in the art will understand that magnetic trip bars in accordance with this invention may include more than or less than three armature interfaces 218*a*-218*c*, for use with circuit breakers that include more or less than three electrical poles. For example, a single armature interface may be used with a single-pole circuit breaker. Likewise, four armature interfaces may be used with a four-pole circuit breaker.

Magnetic trip bar 210 optionally may include a first extension 221 and a second extension 222, each of which may be coupled to accessories (not shown) in the circuit breaker. In the illustrated example, second extension 222 projects horizontally from a second surface 224 of magnetic trip bar 210, and first extension 221 projects vertically from a third surface 223 of magnetic trip bar 210. As illustrated in FIG. 1F, first extension 221 and second extension 222 are aligned (e.g., along an imaginary x-axis) on magnetic trip bar 210. Persons of ordinary skill in the art will understand that magnetic trip bars in accordance with this invention may include more or less than two extensions, and that extensions may be located at other positions on magnetic trip bar 210.

Thermal trip bar 110 may be made from one or more of a plastic, a metal, a polymer, a resin, or other suitable material. Thermal trip bar 110 may have a length of between about 150 mm and about 200 mm, a height of between about 20 mm and about 30 mm, and a thickness between about 10 mm and about 20 mm. Other dimensions may be used.

Magnetic trip bar 210 may be made from one or more of a plastic, a metal, a polymer, a resin, or other suitable material. Magnetic trip bar 210 may have a length of between about 150 mm and about 200 mm, a height of between about 20 mm and about 30 mm, and a thickness between about 10 mm and about 20 mm. Other dimensions may be used.

As illustrated in FIGS. 1A-1B, thermal trip bar 110 and magnetic trip bar 210 may both be mounted on a cylindrical rod 122 having a center axis 112' aligned with pivot point 112. In particular, cylindrical bores 120 of thermal trip bar 110 and cylindrical bores 220 of magnetic trip bar 210 each may be adapted to receive cylindrical rod 122. Further, thermal trip bar 110 and magnetic trip bar 210 each may freely rotate about cylindrical rod 122. In this regard, thermal trip bar 110 and magnetic trip bar 210 are both disposed about pivot point 112.

FIGS. 1A-1B depict thermal trip bar 110 disposed on cylindrical rod 122 in an initial position, and magnetic trip bar 210 disposed on cylindrical rod 122 in an initial position, with first surface 124 of thermal trip bar 110 adjacent second surface 224 of magnetic trip bar 210. In addition, in the initial position, latch mechanism 116 of thermal trip bar 110 extends through opening 216 of magnetic trip bar 210.

Referring now to FIGS. 2A-2D, an example operation of thermal-magnetic trip unit 100 in accordance with this invention is described. Thermal-magnetic trip unit 100 may be coupled to a spring-loaded actuator 300, a bi-metal element 400 and a magnetic assembly 500 of a circuit breaker magnetic structure, such as a translational magnetic system. Spring-loaded actuator 300 includes cylindrical support members 310, a latch surface 320, a spring 330, and an extension 340. Bi-metal element 400 includes bi-metal strip 410 and a contact surface 420. Magnetic assembly 500 includes armature assembly 510 and slide 520. Persons of ordinary skill in the art will understand that thermal-magnetic trip units in accordance with this invention may be used with other actuator, thermal detection and magnetic detection devices.

Figure 2B:
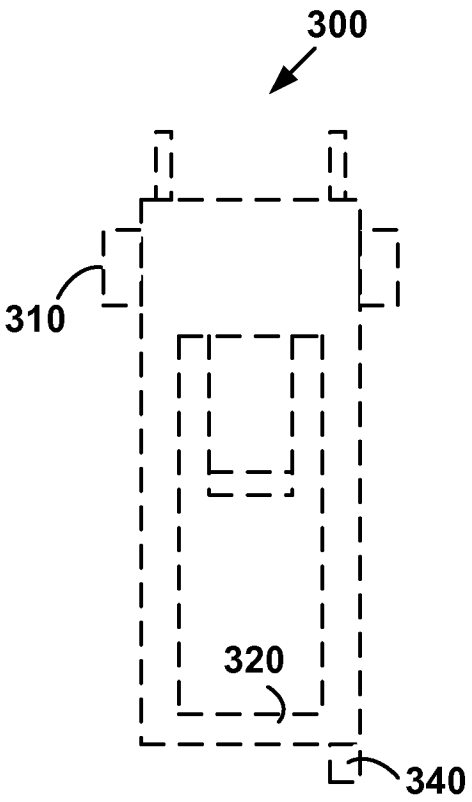
FIG. 2B is a front view of an example spring-loaded actuator illustrated in FIG. 2A.
Figure 2A:
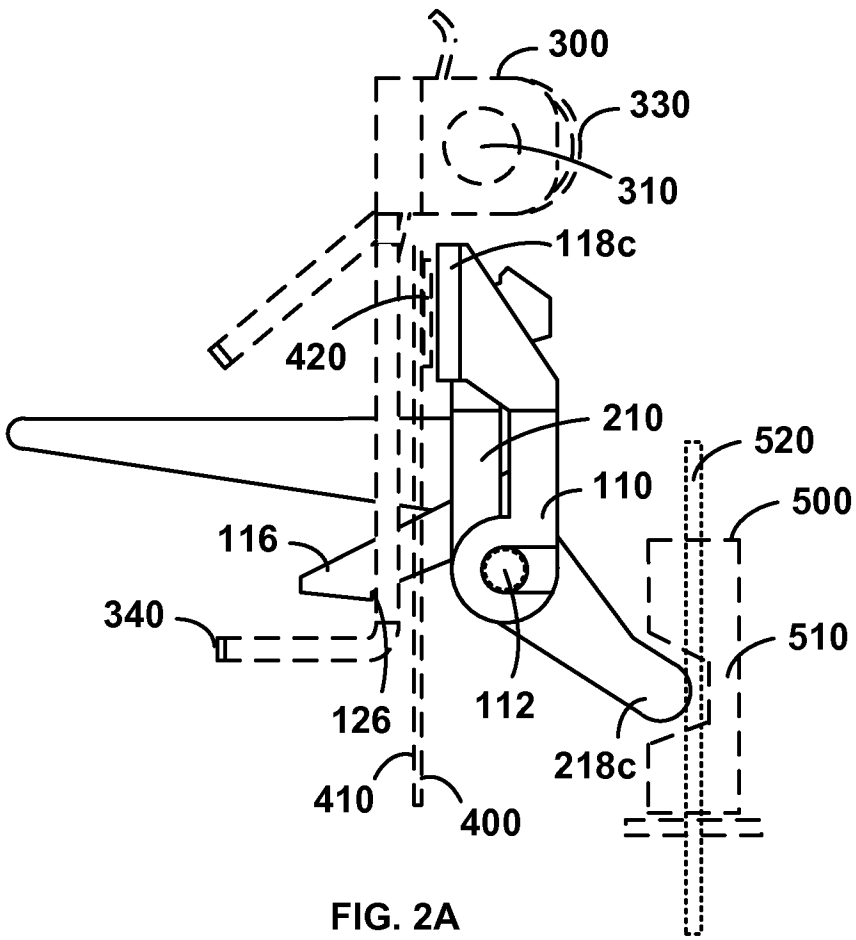
FIG. 2A is another side view of an example thermal-magnetic trip unit in accordance with this invention.

FIG. 2A depicts the configuration of thermal-magnetic trip unit 100, spring-loaded actuator 300, bi-metal element 400 and magnetic assembly 500 in an initial, non-trip condition. Spring-loaded actuator 300 pivots on cylindrical support members 310, and spring 330 tends to bias spring-loaded actuator 300 so that latch surface 320 and extension 340 pivot up and away from thermal-magnetic trip unit 100. In the configuration of FIG. 2A, latch mechanism 116 of thermal trip bar 110 and spring-loaded actuator 300 are cooperatively coupled to prevent such pivoting.

In particular, latch tab 126 of latch mechanism 116 engages latch surface 320 of spring-loaded actuator 300. In this initial configuration, thermal trip bar 110 and magnetic trip bar 210 are in their initial positions, the trip mechanism of the circuit breaker is not activated, and the electrical contacts of the circuit breaker remain closed. Bi-metal strip 410 and armature assembly 510 are each in their initial positions.

Figure 2D:
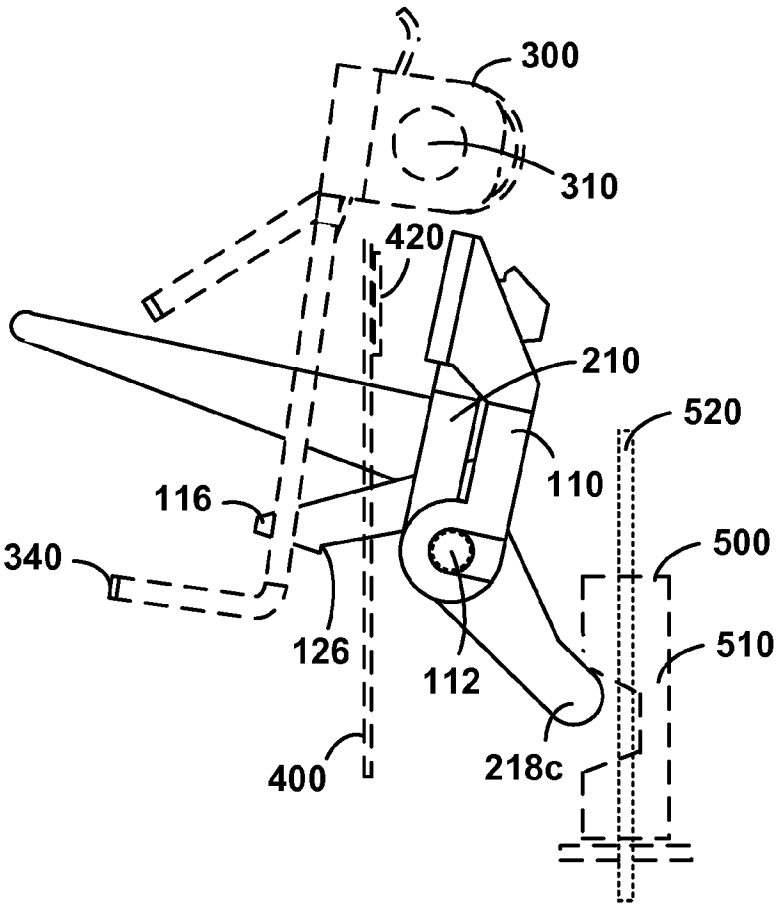
FIG. 2D is a side view of the example thermal-magnetic trip unit of FIG. 2A in a short-circuit operating condition.
Figure 2C:
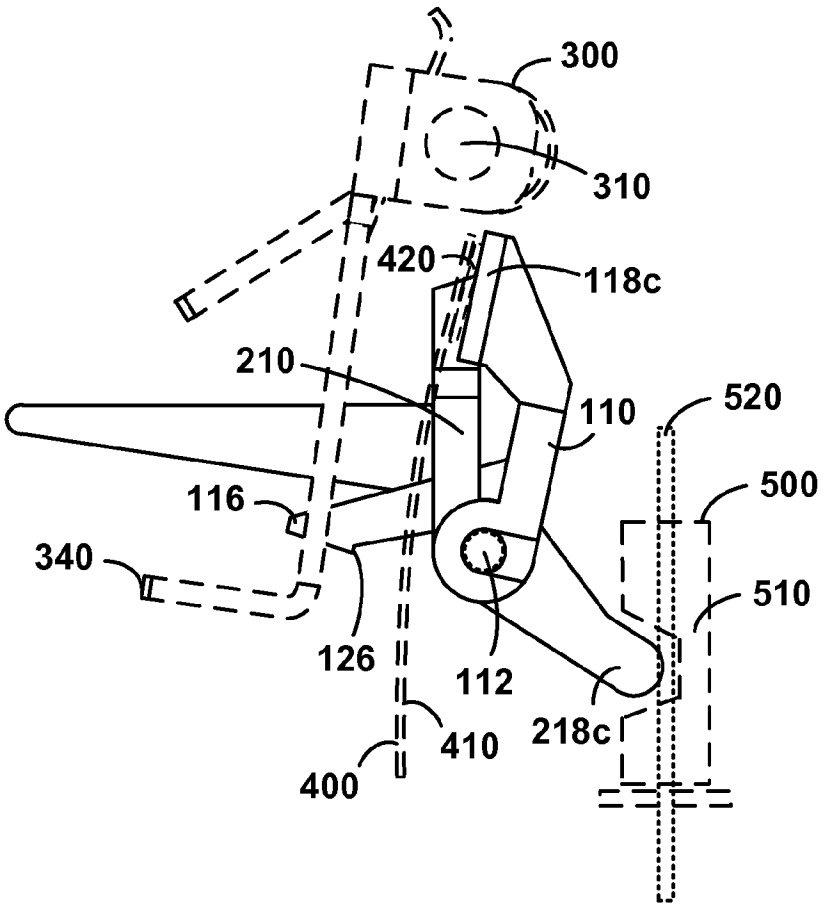
FIG. 2C is a side view of the example thermal-magnetic trip unit of FIG. 2A in an over-current operating condition.

Referring now to FIG. 2C, the operation of thermal-magnetic trip unit 100 in a first operating condition (e.g., an over-current or thermal trip condition) is described. When an over-current condition occurs, the temperature of bi-metal element 400 increases, and bi-metal strip 410 begins to deflect from its initial position. If the temperature of bi-metal element 400 increases sufficiently, due to the current draw exceeding a predefined level, contact surface 420 engages bi-metal interface 118*c* of thermal trip bar 110. As a result, thermal trip bar 110 rotates clockwise about pivot point 112 from its initial position to a second, tripped position.

In the tripped position, latch tab 126 disengages latch surface 320 of spring-loaded actuator 300, and extension 340 pivots up and away from thermal-magnetic trip unit 100 to activate a trip mechanism (not shown) and open electrical contacts (not shown) of the circuit breaker. As shown in FIG. 2C, in the over-current condition, although thermal trip bar 110 rotates about pivot point 112 from its initial position to the tripped position, magnetic trip bar 210 remains in its initial position. In this regard, in an over-current operating condition, thermal trip bar 110 rotates about pivot point 112 substantially independently of magnetic trip bar 210.

Referring now to FIG. 2D, the operation of thermal-magnetic trip unit 100 in a second operating condition (e.g., a short-circuit or magnetic trip condition) is described. The circuit breaker includes an electromagnet (not shown) that generates a magnetic field in proportion to the current level. When a short circuit condition occurs, the magnetic field is sufficiently strong to cause armature assembly 510 to move downward from its initial position on slide 520. As a result, armature assembly 510 engages armature interface 218*c* of magnetic trip bar 210, which causes magnetic trip bar 210 to rotate clockwise about pivot point 112. In addition, second surface 224 of magnetic trip bar 210 engages first surface 124 of thermal trip bar 110, which causes thermal trip bar 110 to rotate clockwise about pivot point 112 from its initial position to the second, tripped position.

In the tripped position, latch tab 126 disengages latch surface 320 of spring-loaded actuator 300, and extension 340 pivots up and away from thermal-magnetic trip unit 100 to activate the trip mechanism and open electrical contacts of the circuit breaker. As shown in FIG. 2D, in the short circuit condition, thermal trip bar 110 and magnetic trip bar 210 both rotate about pivot point 112 from their initial positions to the tripped position.

As described above, magnetic trip bar 210 optionally may include first extension 220 and second extension 222, each of which may be coupled to accessories (not shown) in the circuit breaker. In an over-current condition, because magnetic trip bar 210 remains in its initial position, first extension 220 and second extension 222 each remain in their initial positions. Thus, if the circuit breaker trips, but the first extension 220 and second extension 222 remain in their initial positions, the cause of the trip was an over-current condition.

In a short circuit condition, in contrast, magnetic trip bar 210 rotates from its initial position to a tripped position, and first extension 220 and second extension 222 likewise move from their initial positions to tripped positions. In this regard, if the circuit breaker trips, first extension 220 and second extension 222 may be used to identify that the cause of the trip was a short circuit trip condition.

In the example thermal-magnetic trip unit 100 described above, because bi-metal interfaces 118*a*-118*c* are disposed on a common thermal trip bar 110, and armature interfaces 218*a*-218*c* are disposed on a common magnetic trip bar 110, an over-current condition or a short circuit on any pole of the circuit breaker will activate the trip mechanism and open electrical contacts of the circuit breaker for all poles of the circuit breaker.

The foregoing merely illustrates the principles of this invention, and various modifications can be made by persons of ordinary skill in the art without departing from the scope and spirit of this invention.

The invention claimed is:

1. A trip unit for a circuit breaker that includes electrical contacts, a trip mechanism, a bimetallic strip, and an armature, the trip unit comprising:
- a first trip bar coupled to the trip mechanism and disposed about a pivot point; and
- a second trip bar coupled to the first trip bar and disposed about the pivot point,
- wherein:
  - in a first operating condition, the first trip bar rotates about the pivot point substantially independently of the second trip bar, and activates the trip mechanism to open the electrical contacts;
  - in a second operating condition, the second trip bar rotates about the pivot point, causing the first trip bar to rotate about the pivot point and activate the trip mechanism to open the electrical contacts.

2. The trip unit of claim 1, wherein in the first operating condition, the bimetallic strip causes the first trip bar to rotate about the pivot point.

3. The trip unit of claim 1, wherein the first operating condition comprises an over-current condition.

4. The trip unit of claim 1, wherein in the first operating condition, the second trip bar does not rotate about the pivot point.

5. The trip unit of claim 1, wherein in the second operating condition, the armature causes the second trip bar to rotate about the pivot point.

6. The trip unit of claim 1, wherein the second operating condition comprises a short circuit condition.

7. The trip unit of claim 1, wherein the first trip bar comprises a first interface, wherein the bimetallic strip contacts the first interface in the first operating condition.

8. The trip unit of claim 1, wherein the second trip bar comprises a second interface, wherein the armature contacts the second interface in the second operating condition.

9. The trip unit of claim 1, wherein the first trip bar comprises a latch mechanism adapted to secure a spring-loaded actuator.

10. The trip unit of claim 9, wherein in the first operating condition and the second operating condition, the latch mechanism disengages the spring-loaded actuator to trip the circuit breaker.

11. A circuit breaker comprising:
- electrical contacts;
- a trip mechanism;
- a bimetallic strip;
- an armature;
- a trip unit comprising:
  - a first trip bar coupled to the trip mechanism and disposed about a pivot point; and
  - a second trip bar coupled to the first trip bar and disposed about the pivot point,
  - wherein:
    - in a first operating condition, the first trip bar rotates about the pivot point substantially independently of the second trip bar, and activates the trip mechanism to open the electrical contacts;
    - in a second operating condition, the second trip bar rotates about the pivot point, causing the first trip bar to rotate about the pivot point and activate the trip mechanism to open the electrical contacts.

12. The circuit breaker of claim 11, wherein in the first operating condition, the bimetallic strip causes the first trip bar to rotate about the pivot point.

13. The circuit breaker of claim 11, wherein the first operating condition comprises an over-current condition.

14. The circuit breaker of claim 11, wherein in the first operating condition, the second trip bar does not rotate about the pivot point.

15. The circuit breaker of claim 11, wherein in the second operating condition, the armature causes the second trip bar to rotate about the pivot point.

16. The circuit breaker of claim 11, wherein the second operating condition comprises a short circuit condition.

17. The circuit breaker of claim 11, wherein the first trip bar comprises a first interface, wherein the bimetallic strip contacts the first interface in the first operating condition.

18. The circuit breaker of claim 11, wherein the second trip bar comprises a second interface, wherein the armature contacts the second interface in the second operating condition.

19. The circuit breaker of claim 11, wherein the first trip bar comprises a latch mechanism adapted to secure a spring-loaded actuator.

20. The circuit breaker of claim 19, wherein in the first operating condition and the second operating condition, the latch mechanism disengages the spring-loaded actuator to trip the circuit breaker.

21. A trip method for use with a circuit breaker that includes electrical contacts, a trip mechanism, a bimetallic strip, and an armature, the trip method comprising:

providing a first trip bar coupled to the trip mechanism and disposed about a pivot point;

providing a second trip bar coupled to the first trip bar and disposed about the pivot point;

in a first operating condition, rotating the first trip bar about the pivot point substantially independently of the second trip bar, and activating the trip mechanism to open the electrical contacts; and in a second operating condition, rotating the second trip bar about the pivot point, causing the first trip bar to rotate about the pivot point and activate the trip mechanism to open the electrical contacts.

22. The trip method of claim 21, wherein in the first operating condition, the bimetallic strip causes the first trip bar to rotate about the pivot point.

23. The trip method of claim 21, wherein the first operating condition comprises an over-current condition.

24. The trip method of claim 21, wherein in the first operating condition, the second trip bar does not rotate about the pivot point.

25. The trip method of claim 21, wherein in the second operating condition, the armature causes the second trip bar to rotate about the pivot point.

26. The trip method of claim 21, wherein the second operating condition comprises a short circuit condition.

27. The trip method of claim 21, wherein the first trip bar comprises a first interface, and wherein the trip method further comprises causing the bimetallic strip to contact the first interface in the first operating condition.

28. The trip method of claim 21, wherein the second trip bar comprises a second interface, and wherein the trip method further comprises causing the armature to contact the second interface in the second operating condition.

29. The trip method of claim 21, further comprising providing the first trip bar with a latch mechanism adapted to secure a spring-loaded actuator.

30. The trip method of claim 29, further comprising in the first operating condition and the second operating condition, causing the latch mechanism to disengage the spring-loaded actuator to trip the circuit breaker.

* * * * *